US005621452A

United States Patent [19]

Okumura

[11] Patent Number: 5,621,452

[45] Date of Patent: Apr. 15, 1997

[54] HEAT-SENSITIVE STENCIL-PRODUCTION DEVICE CAPABLE OF PRINT CHECKING FUNCTION WITH PRINTED DOT IMAGE

[75] Inventor: Takashi Okumura, Nagoya, Japan

[73] Assignee: Brother Kogyo Kabushiki Kaisha, Nagoya, Japan

[21] Appl. No.: 270,243

[22] Filed: Jul. 5, 1994

[30] Foreign Application Priority Data

Jul. 16, 1993 [JP] Japan ..... 5-176513

[51] Int. Cl.[6] ..... B41J 2/32; B41J 2/35

[52] U.S. Cl. ..... 347/171

[58] Field of Search ..... 347/171, 211, 347/200; 400/120.01, 82, 83; 101/114, 128.4, 128.21, 121, 125

[56] References Cited

U.S. PATENT DOCUMENTS 4,568,951 2/1986 Hasegawa et al. ..... 347/171
5,329,848 7/1994 Yasui et al. ..... 101/121

FOREIGN PATENT DOCUMENTS 0589710 3/1994 European Pat. Off. .
2057357 2/1990 Japan .
3208675 9/1991 Japan ..... 347/211
5-330220 12/1993 Japan .

OTHER PUBLICATIONS

Patent Abstracts of Japan, vol. 14, No. 228 (M-0973), May 15, 1990.

*Primary Examiner*—Benjamin R. Fuller
*Assistant Examiner*—L. Anderson
*Attorney, Agent, or Firm*—Oliff & Berridge

[57] ABSTRACT

A heat-sensitive stencil production device capable of obtaining both quality stamps without excessive soaking by a stencil plate and quality print without whitened-out areas by a heat-sensitive recording sheet. A sheet distinction switch determines whether a stencil plate or a heat-sensitive recording sheet has been inserted into the stencil production device. When a stencil plate is detected, a first control mode is set and the transport/head pressing motor and a thermal head are driven so that a corresponding appropriate image is formed on the heat-sensitive stencil sheet of the stencil plate in a mirror image. When a heat-sensitive recording sheet is detected, a second mode is selected and the transport/head pressing motor and the thermal head are driven so that a corresponding appropriate image is formed on the heat-sensitive recording sheet by printing dot data of the inputted image from the tail end.

23 Claims, 11 Drawing Sheets

HEAT-SENSITIVE STENCIL-PRODUCTION DEVICE CAPABLE OF PRINT CHECKING FUNCTION WITH PRINTED DOT IMAGE

BACKGROUND OF THE INVENTION

The present invention relates to an image forming device for forming dot images in a heat sensitive image recording medium. More particularly, the invention relates to a heat-sensitive stencil-producing device for forming in a heat-sensitive stencil sheet perforated dot images such as marks and characters for transcribing to on an image-receiving sheet and also for forming in a heat-sensitive image recording sheet a printed dot image.

A stencil plate generally includes a heat-sensitive stencil sheet and an ink-impregnated body that is impregnated with ink, the latter being covered by the heat-sensitive stencil sheet. The heat-sensitive stencil-producing device includes a heating device for thermally perforating the heat-sensitive stencil sheet of the stencil plate, and a transport device for providing relative movement between the stencil plate and the heating device.

There has been known a conventional device of this type wherein the stencil plate is inserted in a heat-sensitive stencil-producing device. The heat-sensitive stencil sheet is transported by a motor and has a stencil made therein (i.e., is thermally perforated) by a thermal head. The stencil is a mirror image. This stencil plate is attached to a stamp block and pressed on a print sheet using the stamp block. This forces the ink in the ink-impregnated body through the perforations of the stencil formed in the heat-sensitive stencil sheet.

SUMMARY OF THE INVENTION

The present inventor has been engaging in inhouse R & D activities with respect to a heat-sensitive stencil production device. One of the inventions is the device that uses the thermal head and the motor in order to form a positive image on a heat-sensitive recording sheet in order to confirm what the mirror image of the stencil will look like stamped on the print sheet. Such device is described in Japanese Patent Application Kokai No. HEI-5-330220 published on Dec. 14, 1993.

The heat-sensitive recording sheet has other uses in addition to the one explained above. For example, it can be attached to the back surface of a completed stencil plate to identify the image of the stencil plate or can be used as a label on a file, thereby increasing the importance of how well the positive image is printed on the heat-sensitive recording sheet.

After the heat-sensitive stencil sheet of the stencil plate is thermally perforated with the mirror image using the thermal head, when the stencil plate is attached to the stamp block with the stencil sheet facing downward and stamped on a print sheet, it is known that the ink filling the ink-impregnated body oozes through the perforations in the heat-sensitive stencil sheet and spreads into (soaks) the print sheet. For this reason, decreasing the size of the perforations in the heat-sensitive stencil sheet improves the quality of the stamp. That is, the energizing power of the thermal head should be set low so that the amount of heat generated thereby reduces accordingly and the size of perforations produced thereby also reduces.

However, it has been known that with this device, when a positive image is formed on the heat-sensitive recording sheet with this device, the lines and blackened areas of the image are sometimes have whitened-out (white-out) portions so that print quality is poor.

This problems occurs because the energizing power supplied to the head has been decreased to improve quality of stencil-formed stamps. Therefore, a large amount of heat is not transmitted to the heat-sensitive recording sheet from the thermal elements of the thermal head and the heat-sensitive recording sheet is transported past the thermal head before sufficiently changing color.

On the other hand, setting the energizing power supplied to the thermal head higher in order to sufficiently color the heat-sensitive recording sheet enlarges the perforations formed in the heat-sensitive stencil sheet of the stencil plate. As a result, the amount of ink that soaks into the print sheet during stamping increases and quality of stamped images is poor. Because of these conflicting requirement, improving quality of both stamped images on the image receiving sheet through the stencil plate and printed images on the heat sensitive recording sheet is considered to be difficult.

It is an objective of the present invention to overcome the above-described problems and provide a heat-sensitive stencil-production device capable of obtaining stamp quality without excessive flow of ink by a stencil plate and at the same time capable of obtaining print quality on a heat sensitive image recording sheet without whitened-out areas.

These and other objects of the present invention will be attained by providing an improved image forming device for forming a dot image on a heat-sensitive image recording medium of the present invention. The device includes heating means, transport means, an insertion section, distinction means, and control means. The heating means is adapted for thermally forming the dot image on the heat-sensitive image recording medium. The transport means is adapted for providing relative movement between the heating means and the heat-sensitive image recording medium in a transport direction. The inserting section is adapted for inserting the heat-sensitive image recording medium into the heating means. The heat-sensitive image recording medium includes a first heat-sensitive image recording medium which forms a first dot image and a second heat-sensitive image recording medium which forms a second dot image. The distinction means is adapted for distinguishing the first heat-sensitive image recording medium from the second heat-sensitive image recording medium upon insertion of one of the first and second heat-sensitive image recording mediums at the insert section. The control means is connected to the distinction means for automatically switching at least one of the heating means and the transport means between their first control mode and second control mode in response to a distinction result from the distinction means. The first dot image is formed under the first control mode, and the second dot image is formed under the second control mode, so that at least one of size and density of dots generated in the first dot image is smaller and lower than those generated in the second dot image.

In another aspect of the invention, there is provided an improved heat-sensitive stencil production device for producing a stencil in a stencil plate. The stencil plate includes a heat-sensitive stencil sheet and an ink-impregnated body covered with the heat-sensitive stencil sheet. The device includes heating means, transport means, an insertion section, distinction means, and control means. The heating means is adapted for thermally forming perforated dot image in the heat-sensitive stencil sheet. The transport means is adapted for providing relative movement between the heating means and the stencil plate for stepwisely feeding the heat-sensitive stencil sheet in a transport direction. The inserting section is adapted for inserting the heat-sensitive stencil plate into the heating means, the insertion section also allows insertion of a heat sensitive recording sheet to which a printed dot image is to be formed by the heating means. The distinction means is adapted for distinguishing between whether the stencil plate or the heat-sensitive recording sheet is set. The control means is connected to the distinction means for automatically switching, based on the distinction result from the distinction device, between a first control mode for controlling at least one of the transport means and the heating means for producing the dot image in the stencil plate and a second control mode for controlling at least one of the transport means and the heating means for producing the printed dot image in the heat-sensitive recording sheet, so that at least one of dot size and dot density of the dot image in the stencil plate being smaller and lower than those of the dot image in the heat-sensitive recording sheet.

In the first control mode the transport means and/or the heating means is controlled by the control means for producing a stencil (perforated dot image) in the first heat-sensitive image recording medium such as a stencil plate.

In the second control mode the transport means and/or the heating means is controlled by the control means for heat-sensitive recording on the second heat-sensitive image recording medium such as the heat-sensitive image recording sheet. That is, the present device includes special control modes for both the stencil plate and the heat-sensitive recording sheet that are automatically switched therebetween in response to the distinction results of the distinction means.

In one preferred embodiment, by setting the control means so that the heat amount of the heating means is smaller in the first control mode than in the second control mode, perforations in the first heat sensitive image recording medium or the stencil sheet of the stencil plate can be made sufficiently small to avoid ink blurring when the stencil plate is used for stencil printing. On the other hand, if the second heat sensitive image recording medium or the heat-sensitive recording sheet undergoes dot printing by the present device, a printed dot can be sufficiently printed without white-out portion.

The heating means can be a thermal head which includes a plurality of thermal elements aligned in an array in a direction substantially orthogonal to the transport direction, and the order at which thermal elements of the array are heated can be altered by the control means. In another preferred embodiment, the control means can be set so that a relative movement distance, for each heating of the thermal head, between the second heat sensitive image recording medium (heat-sensitive image recording sheet) and the thermal elements of the thermal head is smaller during the second control mode than the relative moving distance between the first heat-sensitive image recording medium (heat-sensitive stencil sheet) during the first control mode. By this, perforations in the first heat-sensitive image recording medium can be made sufficiently small. On the other hand, printed dot in the second heat-sensitive image recording medium can be sufficiently printed without white-out portion.

In still another preferred embodiment, the control means can set a heating cycle of the thermal head smaller during the second control mode than during the first control mode. By this control, the similar advantage is attainable.

In still another embodiment, the control means can set the heating amount of the thermal head smaller during the first control mode than during the second control mode, and can also set the relative movement distance as described above.

The control means can set a heating amount of the thermal head smaller during the first control mode than during the second control mode, and can also set a heating cycle of the thermal head smaller during the second control mode than during the first control mode.

In summary, in the present invention, when the object to be processed that is set in the heat-sensitive stencil-producing device is the first heat-sensitive image recording medium such as the stencil plate, the most appropriate control therefor is performed in the first control mode so that stamp images can be formed without excessive ink soaking. When the object to be processed that is set in the heat-sensitive stencil-producing device is the heat sensitive image recording medium such as the heat-sensitive recording sheet, the most appropriate control therefor is performed in the second control mode so that printing can be performed on the heat-sensitive recording sheet without producing whitened-out areas. Because the first control mode and the second control mode are automatically switched therebetween, an operator needs only set a stencil plate or a heat-sensitive recording sheet in the device. Thus, easy operation results, making the device very practical.

BRIEF DESCRIPTION OF THE DRAWINGS

In the drawings;

FIG. 8(*b*) is an explanatory diagram showing output in a heat-sensitive image recording sheet by a second control mode;

FIG. 10(*b*) is an explanatory diagram showing perforation when a stencil is produced in the stencil plate using the first control mode;

FIG. 10(*c*) is an explanatory diagram showing permeation of ink when stamping is performed using a stencil plate perforated using the first control mode;

FIG. 10(*d*) is an explanatory diagram showing coloration when a heat-sensitive recording sheet is printed on using the second control mode;

DETAILED DESCRIPTION OF THE PREFERRED EMBODIMENTS

An image forming device for forming a dot image in a heat sensitive image recording medium will be described with reference to drawings. In the embodiment described below, the image forming device is applied to a heat-sensitive stencil-producing device in which a perforated dot image can be formed in a stencil sheet, and a printed dot image can be formed in a heat sensitive recording sheet.

Figure 1:
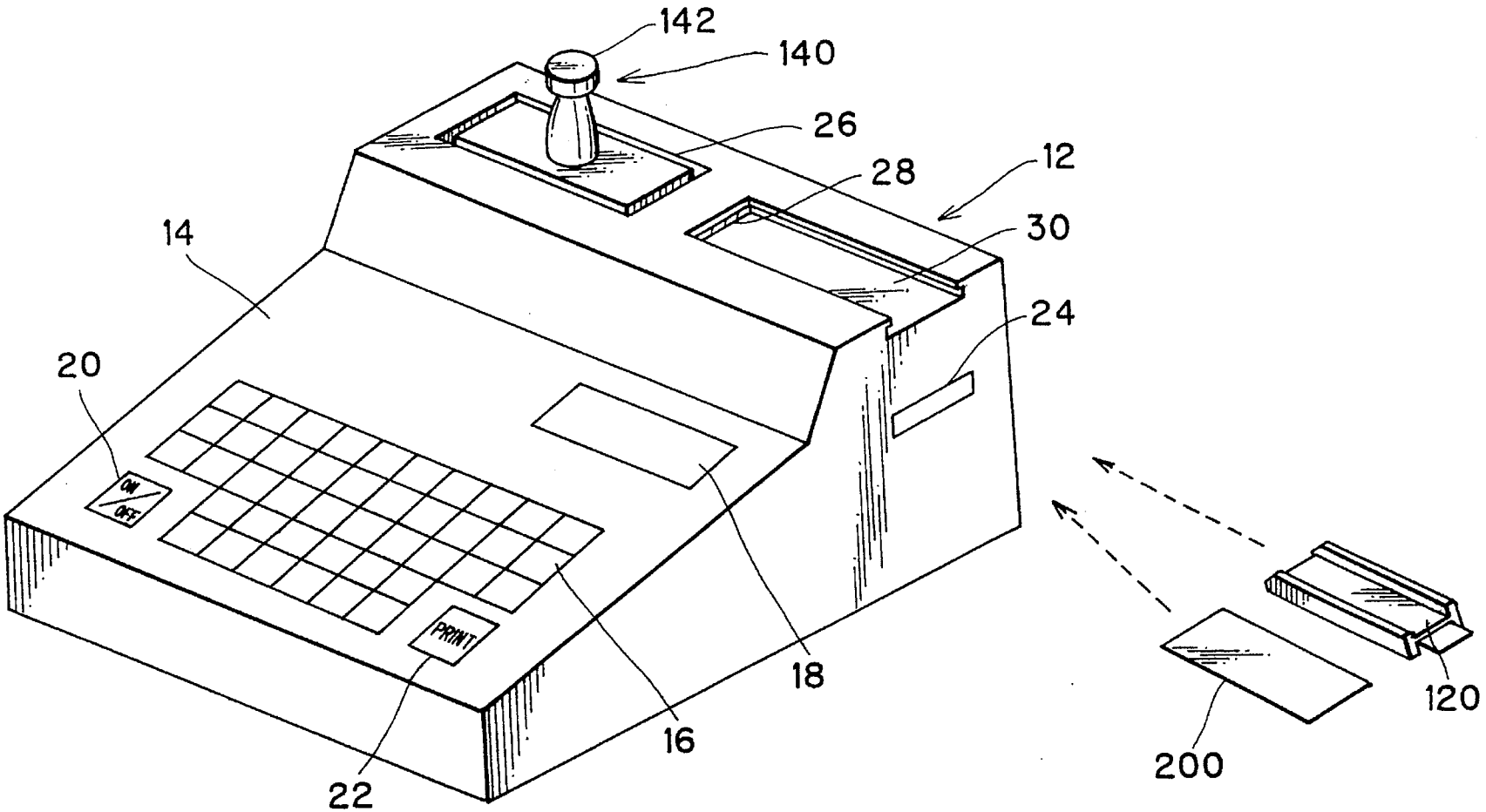
FIG. 1 is a perspective view showing the external appearance of a heat-sensitive stencil-production device according to one embodiment of the present invention.

As shown in FIG. 1, the heat-sensitive stencil-producing device has an outer cover frame 14 and includes a stencil-producing apparatus 12 and a stamp block 140. The stencil-producing apparatus 12 includes, at an upper surface of the cover 14, a keyboard 16 for inputting functions or characters, a liquid crystal displays 18 for displaying the characters and the like according to input from the keyboard 16, an ON/OFF key 20 for indicating whether the power is on or off; and a stencil-production key 22 for indicating production of a stencil.

A stamp receiving portion 26 for receiving the stamp block 140 is provided on a rear upper surface of the cover 14. The stamp receiving portion 26 has a vertical wall portion 261. Further, a discharge guide tray 30 onto which a thin heat-sensitive recording sheet 200 is discharged after printing is provided to the left side. A discharge port 28 connects the discharge guide tray 30 to a stencil-producing mechanism at the interior of the outer frame 14. An insertion port 24 for mounting a stencil plate 120 when producing a stencil and a heat-sensitive recording sheet 200 when printing is provided to the side wall of the cover 14. The heat-sensitive recording sheet 200 is heat-sensitive paper used for printing with a conventional thermal head but cut to match the size of the stencil plate 120.

Figure 2:
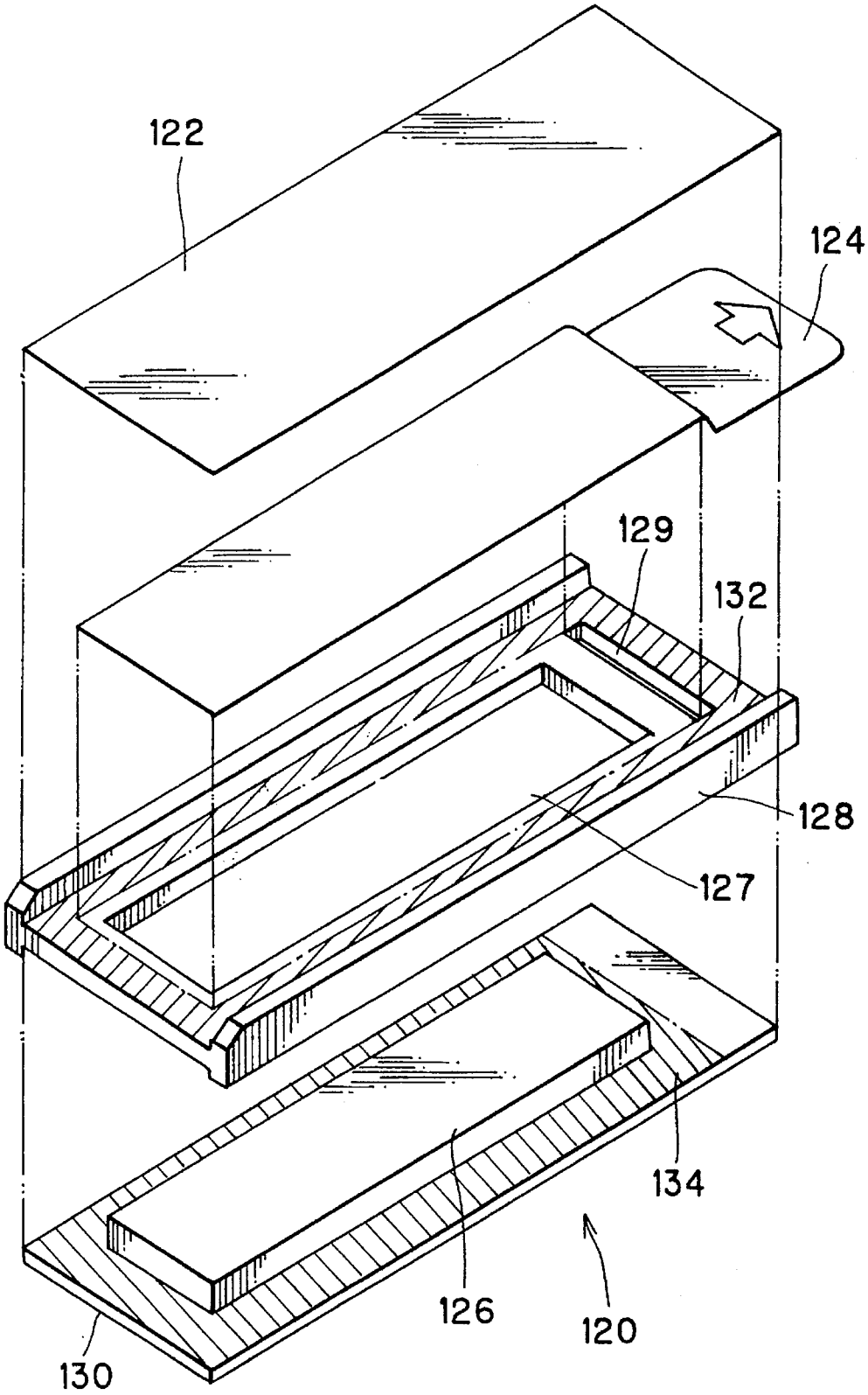
FIG. 2 is an exploded perspective view showing a stencil plate.

As shown in FIG. 2, the stencil plate 120 is made from a heat-sensitive stencil sheet 122, a separator 124, a porous material 126 (porous support body) impregnated with ink, a frame 128 through which an opening 127 is formed so as to surround the porous material 126, and a film 130 (ink-impermeable base material). The porous material 126 is made of an unwoven cloth, Japanese paper, cloth, paper, or an open cell porous rubber such as foam NBR.

A rectangular hole 129, through which the separator 124 is pulled, and an opening 127 are formed through the frame 128. The opening 127 is formed through the central portion of the frame 128 corresponding to the size of the porous material 126. Adhesive 132 for adhering the heat-sensitive stencil sheet 122 to the upper surface of the frame 128 is coated to all the upper surface of the frame 128. Further, adhesive 134 is coated to the upper surface of the film 130. The film 130 is adhered to the lower surface of the frame 128. The porous material 126 is adhered to the film 130 so as to be accommodated in the opening 127 of the frame 128.

The separator 124 is arranged with one its sides at the upper surface of the porous material 126 so as to cover the opening 127. The heat-sensitive stencil sheet 122 is adhered to the upper surface of the frame 128 so that the separator 124 is sandwiched therebetween. The other end of the separator 124 sticks out of the stencil plate 120 after being passed through the rectangular hole 129 provided in the frame 128 and further being passed between the frame 128 and the film 130.

Figure 3:
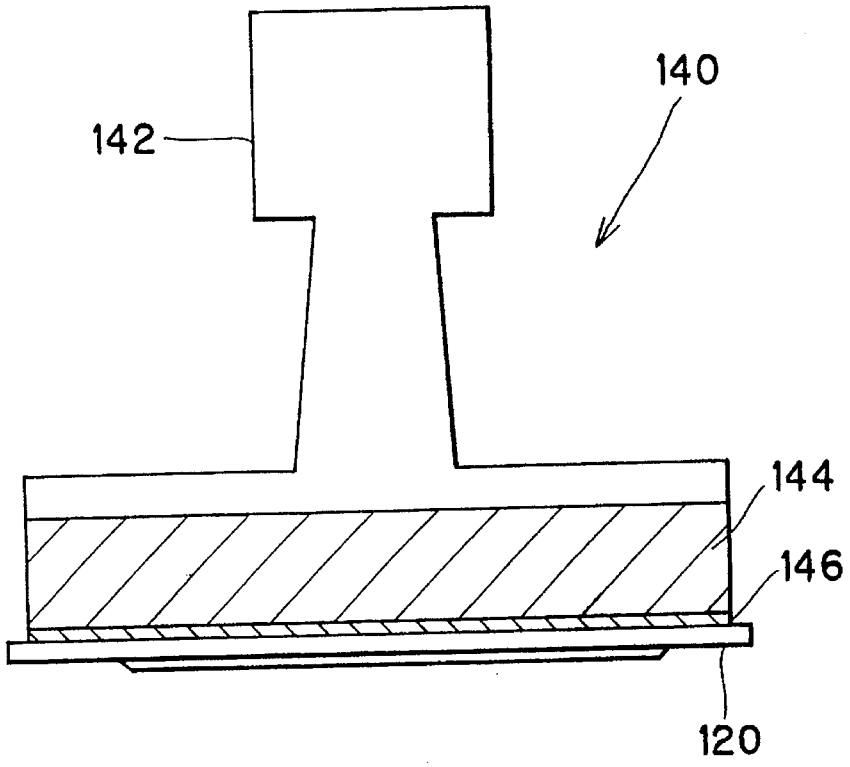
FIG. 3 is a side view showing a stamp block.

A perforation image is formed in the stencil plate 120 constructed as described above by thermally melting the thermoplastic film of the heat-sensitive stencil sheet 122 using a heating device such as the thermal head 32. After mounting the thus-produced stencil plate 120 to the stamp block 140 shown in FIG. 3 with the heat-sensitive stencil sheet 122 facing downward, the separator 124 is pulled out. The stamp block 140 is constructed from a grip 142, a cushion 144, and an adhesive layer 146. The adhesive strength of the adhesive layer 146 is set to a value wherein the stencil plate 120 can be repeatedly attached and detached. Pressing the stamp block 140, with the stencil plate 120 mounted thereto in this way, against a print sheet compresses the porous material 126. The impregnated ink is forced through the perforations of the stamp surface (the heat-sensitive stencil sheet 122) and the ink is transferred to the print sheet.

Figure 4:
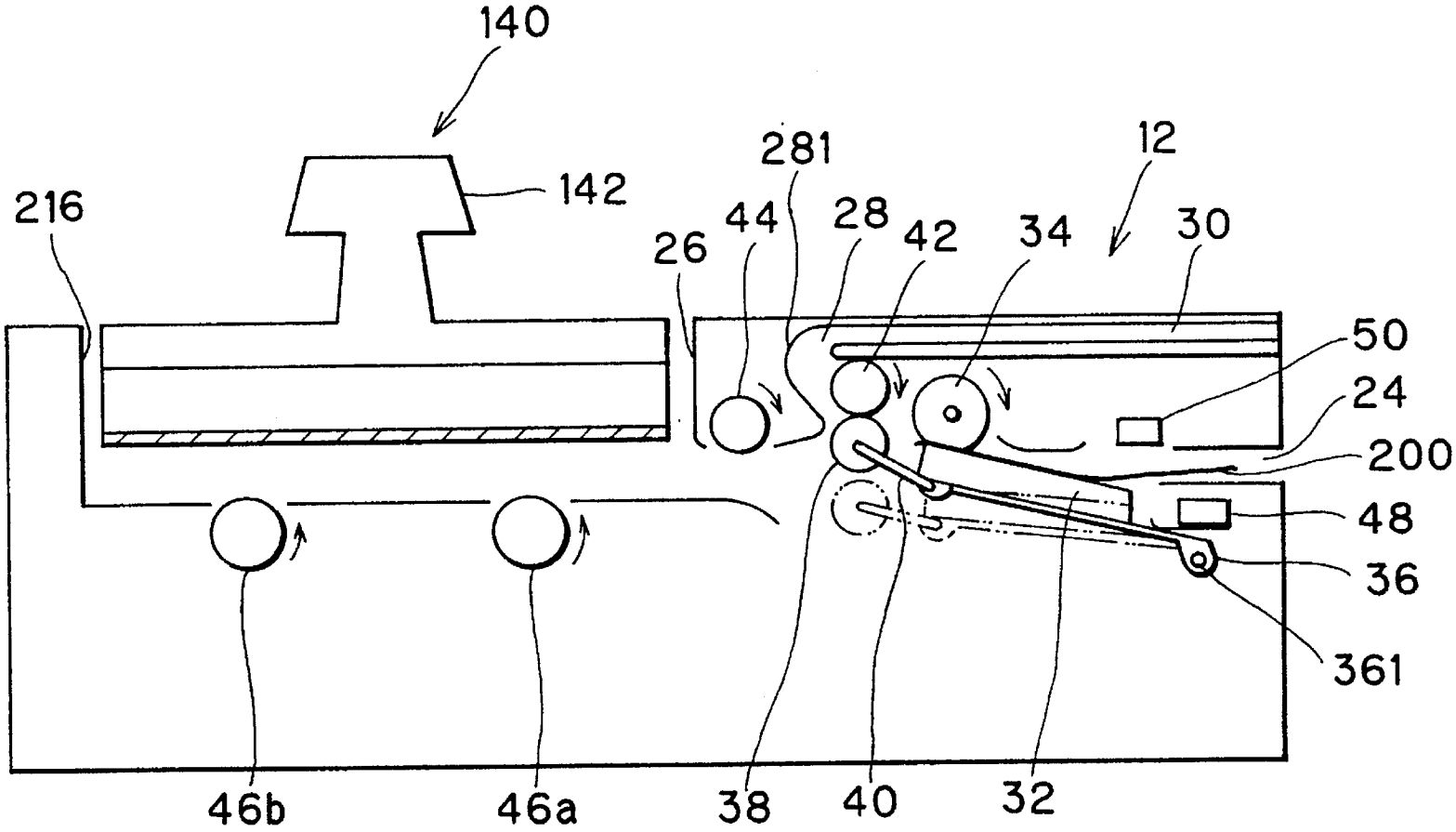
FIG. 4 is an explanatory diagram schematically showing a cross-section of a stencil-production mechanism of the heat-sensitive stencil-production device according to the embodiment.

As shown in FIG. 4, an insertion detection switch 50 for detecting insertion of either the stencil plate 120 or the heat-sensitive recording sheet 200 is attached to the interior of the insertion port 24. A support plate 36 is supported below the insertion detection switch 50 on a shaft 361 so as to be swingable therearound. The support plate 36 is formed integrally with a heat fin that is for supporting the thermal head 32. The support plate 36 is connected to a transport/head pressing motor 94 (see FIG. 11) via a one way clutch mechanism so as to move in connection therewith and is swung by positive or normal rotation of the transport/head pressing motor 94. This motor 94 is a stepping motor. That is, when the transport/head pressing motor 94 rotates a predetermined amount in the normal direction, the support plate 36 pivotally moves upward into the condition indicated by the solid line shown in FIG. 4. When the head pressing motor 94 further rotates from this position a predetermined amount in the normal direction, the support plate 36 pivotally moves downward so as to move from the condition indicated by the solid line in the figure to the condition indicated by the broken line and is further rotated downward. Incidentally, the transport/head pressing motor 94 has another function to drive a platen 34 and a sheet feed roller 42 (described later) upon reverse rotation of the motor 94 for feeding the stencil plate 120 or the heat sensitive recording sheet 200 stepwisely. Therefore, this motor 94 is referred to as "transport" and "head pressing" motor.

The platen 34 is rotatably supported at the interior of the cover frame 14 in confrontation with the thermal head 32 mounted on the support plate 36. The stencil plate 120 and the heat-sensitive recording sheet 200 are sandwiched between the thermal head 32 and the platen 34. That is, when the heat-sensitive recording sheet 200 is sandwiched, the support plate 36 goes into the position indicated by the solid line in FIG. 4, and when the stencil plate 120 is sandwiched the support plate 34 goes into the position shown by the broken line in FIG. 4. This platen 34 is rotated in a direction indicated by an arrow shown in FIG. 4 in response to the reversal rotation of the transport/head pressing motor 94. As is well known, a plurality of thermal elements are arranged in the thermal head 32 so as to extend in parallel with the rotation axis of the platen 34. Each of the thermal elements undergoes control for selective heat generation.

An arm 40 is pivotably mounted on the tip of the support plate 36. A boost roller 38 is supported on the tip of the arm 40 so as to be freely rotatable. A sheet feed roller 42 is provided so as to move in association with the platen 34. The sheet feed roller 42 is supported so as to extend parallel to the rotation axis of the platen 34 on the side of the platen 34 from which paper is fed. The arm 40 is urged by a spring (not shown) to raise the boost roller 38 upward. When the support plate 36 is pivotally moved into the condition indicated by the solid line in FIG. 4, the boost roller 38 is urged by the sheet feed roller 42. A sheet guide 281 for reversing the direction of the heat-sensitive recording sheet 200 and guiding it to the discharge port 28 is provided at the side of the sheet feed roller 42 from which the sheet exits.

A sheet distinction switch 48 is provided near the base end portion of the support plate 36. When the thin heat-sensitive recording sheet 200 is inserted through the insertion port 24, the sheet distinction switch 48 turns "ON" because the support plate 36 swings upward to the condition indicated by the solid line in FIG. 4 because of the thinness of the sheet 200, which allows the support plate 36 to be sufficiently tilted. However, when the stencil plate 120 is inserted into the insertion port 24, the sheet distinction switch 48 is turned "OFF" because the support plate 36 does not swing upward because of the thickness of the stencil pate 120, and remains in the condition indicated by the broken line in FIG. 4.

A feed roller 44 for rotating in association with the platen 34 and feeding a stencil plate 120 is provided at a downstream side of the sheet feed roller 42. The stencil plate 120 is sandwiched between the feed roller 44 and the boost roller 38 and is fed toward a bottom portion of the stamp receiving portion 26.

Feed rollers 46*a* and 46*b* are provided such that parts of these roller surfaces penetrate the bottom of the stamp receiving portion 26. These rollers 46*a*, 46*b* are rotatable in association with the platen 34. A stencil plate 120 fed to the stamp receiving portion 26 by the feed roller 44 and the boost roller 38 is further fed by these rollers 46*a*, 46*b* and is positioned by being pressed against the wall 261 of the stamp receiving portion 26.

Figure 5:
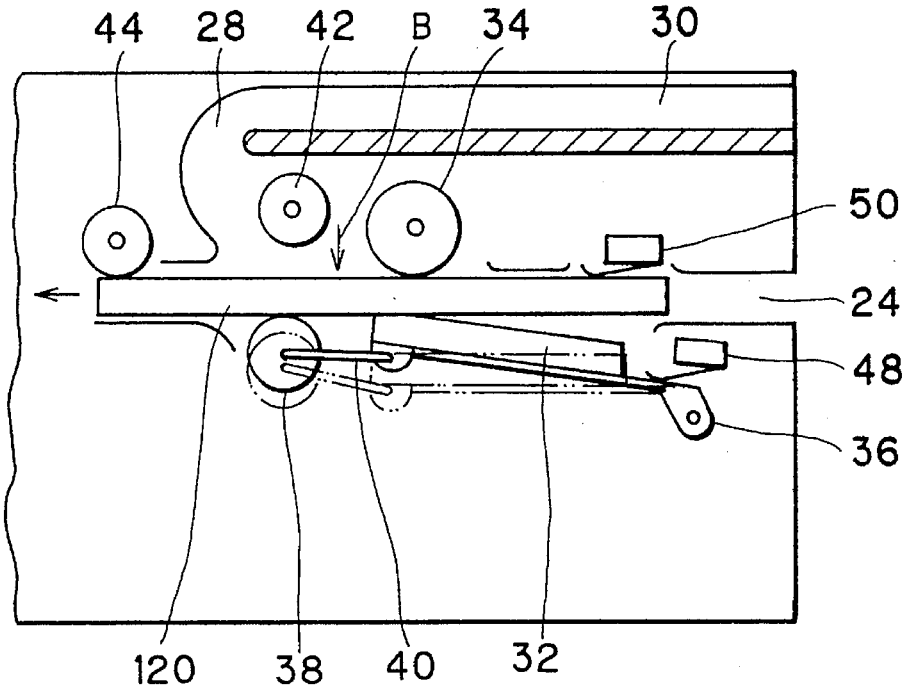
FIG. 5 is an explanatory diagram showing when a stencil is produced in the stencil plate.

FIG. 5 shows a stencil-producing condition of the stencil plate 120. A stencil plate 120 inserted into the device is stopped by a stopper (not shown) that moves in and out of the transport path at the position marked by the arrow B in FIG. 5. A stand-by condition of the thermal head 32 is indicated by the broken line in FIG. 5. In this condition, the sheet distinction switch 48 is rendered "OFF." From the mounted condition, when the stencil-production key 22 is depressed, the positive drive force of the transport/head pressing motor 94 raises the support plate 36 so that the thermal head 32 moves into the condition indicated by the solid line. In this condition, the stencil plate 120 is sandwiched between the platen 34 and the thermal head 32. However, the sheet distinction switch 48 remains "OFF" because of the insufficient inclination of the support plate 36. Because the sheet distinction switch 48 is "OFF," the transport/head pressing motor 94 and the thermal head 32 are driven under a first control mode (to be described later).

After the thermal head 32 is pressed against the platen 34, the stopper (not shown) retracts from the transport path. The platen 34 and the feed roller 44 begin rotating in the feed direction by the reverse drive force of the transport/head pressing motor 94. The feed speed and the frictional force of the rotating feed roller 44 are slightly faster and set slightly weaker respectively than those of the platen 34. Therefore, the stencil plate 120 does not sag between the platen 34 and the feed roller 44, but takes on the feed speed of the platen 34. For each rotational step of the platen 34 (i.e., for each reversal rotational step of the transport/head pressing motor 94), stencil-production data that are inputted by the key board 16 and edited for use in the first control mode is transported to the thermal elements of the thermal head 32 as dot information for each line. Here, "line" implies an array of heated thermal elements. The thermal elements are selectively heated accordingly, thereby thermally perforating the stencil plate 120 so that a stencil is produced.

After a stencil has been produced, the platen 34 and the feed roller 44 continue feeding the stencil plate 120 until finally it is fed to beneath the stamp block 140 by the feed rollers 46*a* and 46*b*. Afterward, feeding operations are completed, the thermal head 32 returns to the position indicated by the dotted line, and operations are completed.

Figure 6:
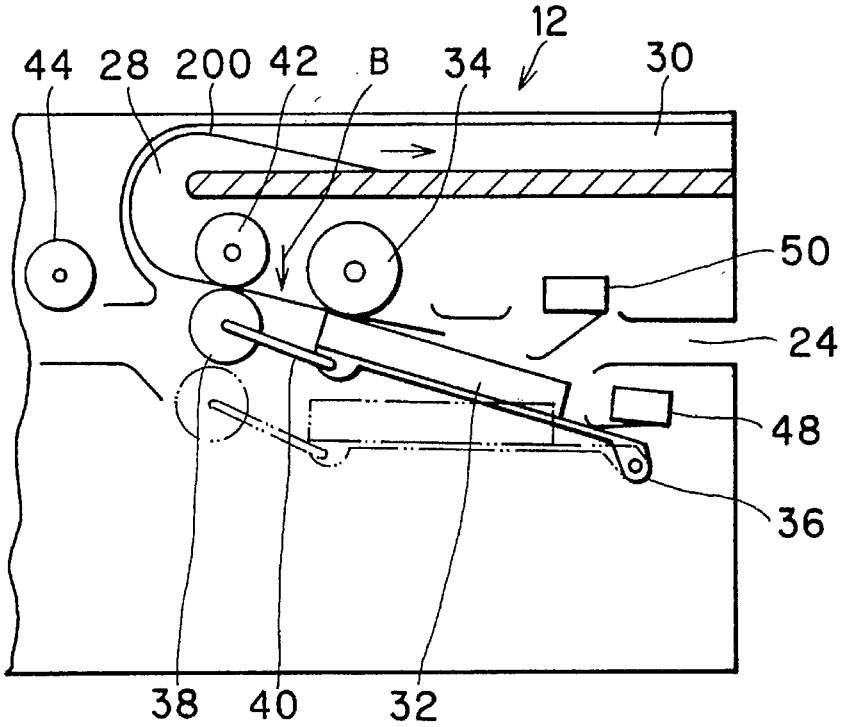
FIG. 6 is an explanatory diagram showing when printing is performed on the heat-sensitive recording sheet.

FIG. 6 shows the heat-sensitive recording sheet 200 in a recording condition. At the position indicated by the arrow B in FIG. 6, the heat-sensitive recording sheet 200 is stopped by the stopper (not shown), At this time, the thermal head 32 is in the standby condition indicated by the dotted line in FIG. 6, and the sheet distinction switch 48 is rendered "OFF." In the mounted condition, when the stencil-production key 22 is depressed, the support plate 36 is rotated by the positive drive force of the transport/head pressing motor 94 so that the thermal head 32 is raised into the position indicated by the solid line in FIG. 6. In this condition the sheet distinction switch 48 is rendered "ON" and the boost roller 38 further contacts the sheet feed roller 42. At this time, because the sheet distinction switch 48 is "ON," the transport/head pressing motor 94 and the thermal head 32 are driven under a second control mode.

After the thermal head 32 is pressed against the platen 34, the stopper retracts out of the transport path, and the platen 34 and the sheet feed roller 42 begin to rotate by reverse drive force of the transport/head pressing motor 94. As described above, the feed speed and the frictional force of the rotating feed roller 44 are slightly faster and set slightly weaker respectively than those of the platen 34. Therefore the heat-sensitive recording sheet 200 does not sag between the platen 34 and the sheet feed roller 42 and takes on the feed speed of the platen 34. For each rotational step of the platen 34 (i.e., for each rotational step of the transport/head pressing motor 94), print data that is inputted and edited for use in a second control mode is transported to the thermal elements of the thermal head 32 as dot information for each line. The thermal elements are selectively heated accordingly, thereby thermally coloring the heat-sensitive recording sheet 200 so that printing is performed. After printing is completed, the platen 34 and the sheet feed roller 42 continue to feed the heat-sensitive recording sheet 200 until it is discharged to the discharge guide tray 30. Afterward, feeding operations are completed, the thermal head 32 returns to the position indicated by the dotted line in FIG. 6 and operations are completed.

The thermal head 32 which forms the heating device and the transport/head pressing motor 94 which forms the transport device are controlled under either the first control mode or the second control mode as described above. These modes will be described in detail below.

Figure 7:
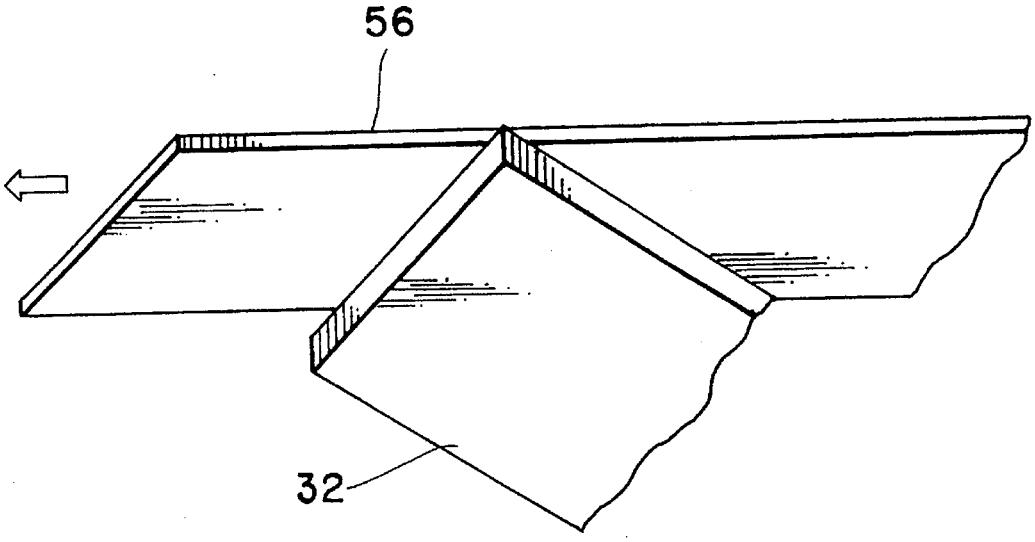
FIG. 7 is an explanatory diagram showing a condition wherein the thermal head abuts the material to be heated.

FIG. 7 shows the thermal head 32 in contact with a material to be heated 56 while the material to be heated 56 is being moved relatively to the thermal head 32 in the direction indicated by an arrow shown. The material to be heated 56 is the stencil plate 120 or the heat-sensitive recording sheet 200. The material to be heated 56 is fed in steps in the direction indicated by the arrow. Dot data is sent to the row of thermal elements of the thermal head 32 at every stepwise feeding according to the edited desired stencil to be produced or the image to be printed. After the data has been established, selected thermal elements are driven according to the data over a designated time, so that heat is applied to desired positions of the material to be heated 56. These operations are repeated at each feed step until finally stencil production or printing is completed.

Figure 8A:
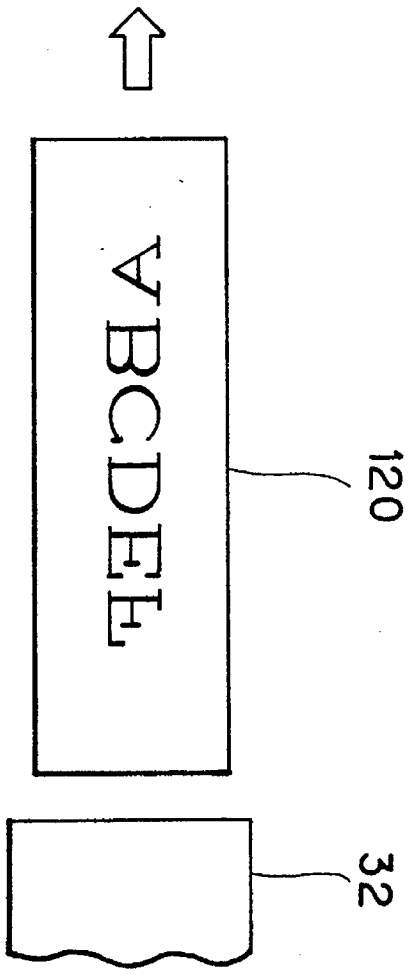
FIG. 8(*a*) is an explanatory diagram showing output when a stencil is produced in a first control mode.
Figure 8B:
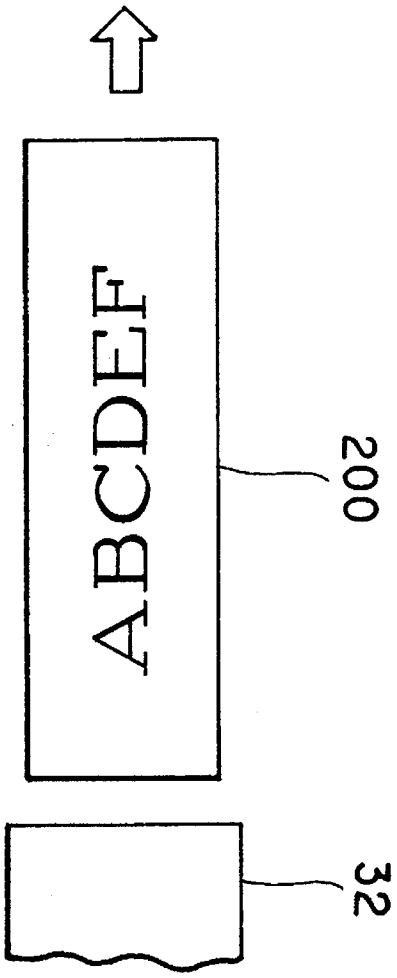

An example of a stencil pattern produced using the first control mode is shown in FIG. 8 (*a*). FIG. 8 (*a*) shows a lower surface of the material to be heated 56 (i.e., the stencil plate 120), the lower surface being in contact with the thermal head 32, The lower surface is viewed as a front view. The image as seen from the front is a mirror image. Because this is a pattern which will become a stamp surface, ink will be transferred from perforations according to this pattern onto a print sheet and will produce a positive image on the print sheet.

Figure 9:
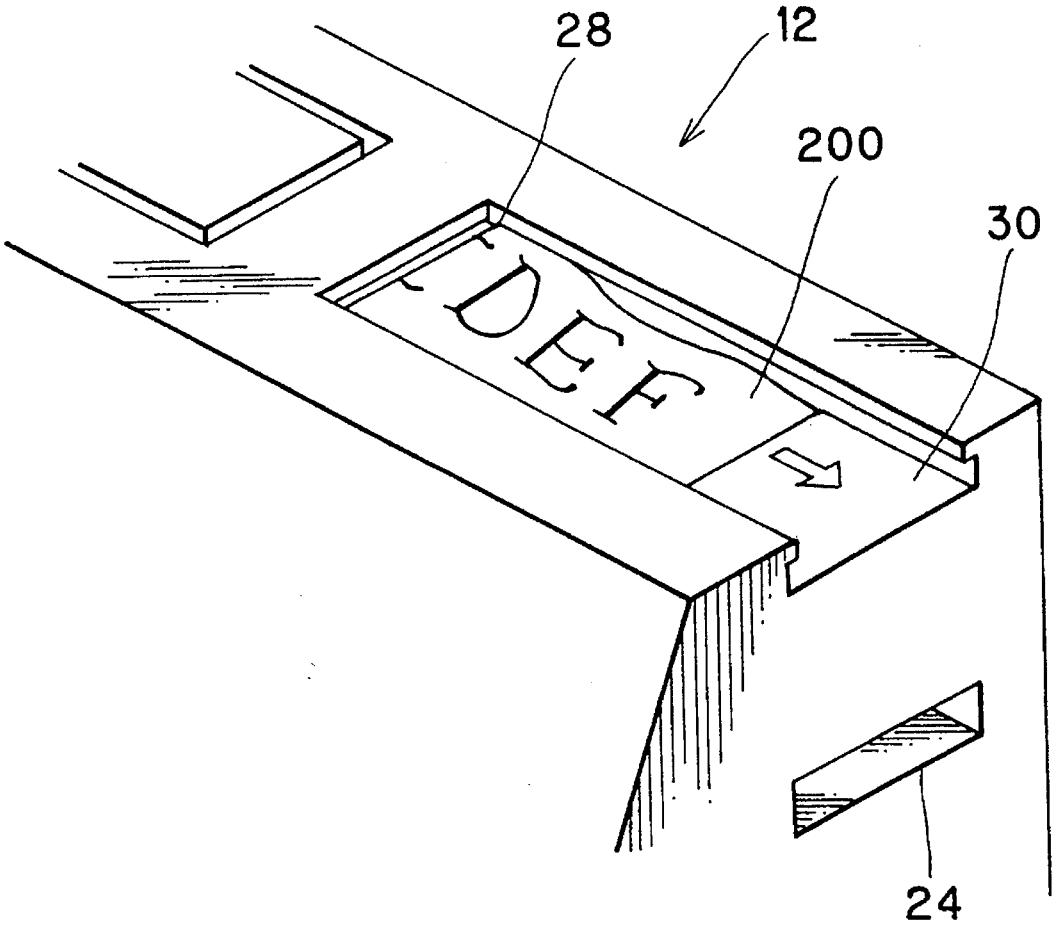
FIG. 9 is a partial perspective view showing an actual output condition for a heat-sensitive recording sheet printed on in the second control mode.
Figure 10A:
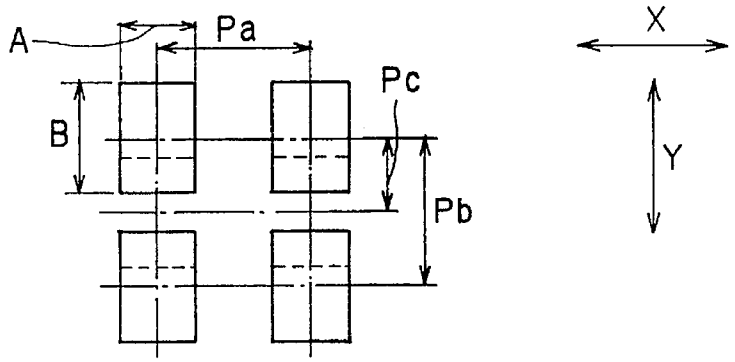
FIG. 10(*a*) is an explanatory diagram showing arrangement of thermal elements in the thermal head and showing relative movement position in a feed direction of thermal elements when a sheet is fed by a transport/head pressing motor.
Figure 10B:
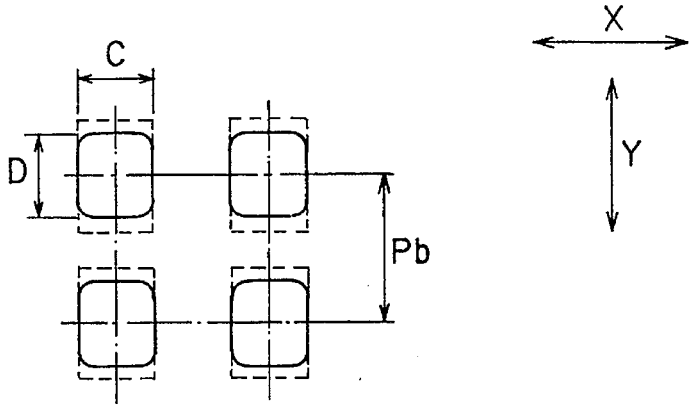
Figure 10C:
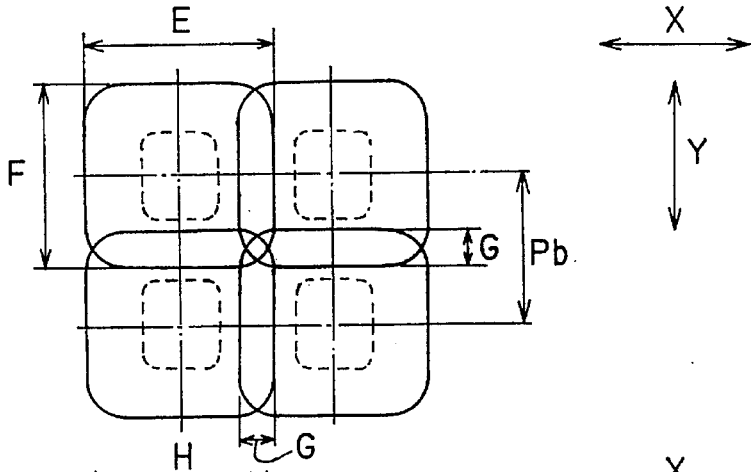
Figure 10D:
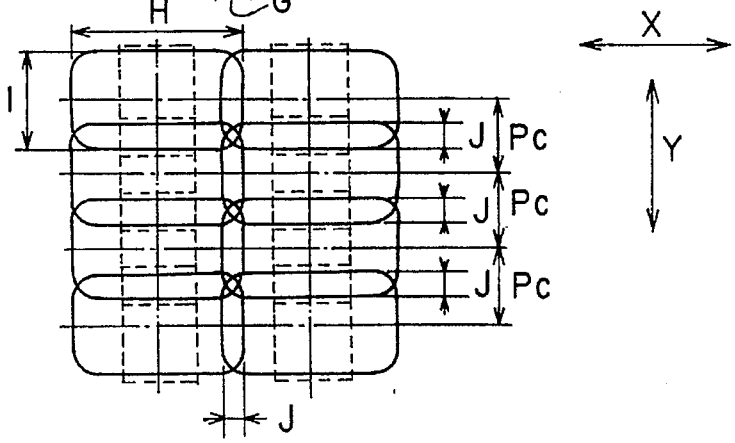

On the other hand, FIG. 8 (*b*) shows a pattern recorded on the heat-sensitive recording sheet 200 using a second control mode. Printing according to the second control mode produces a positive image. However printing occurs from the tail end of the image to be printed. This is performed so that, as shown in FIG. 9, a completed heat-sensitive recording sheet 200 that is discharged from the discharge port 28 onto the discharge guide tray 30 shows a positive image.

Next, will be described with reference to FIGS. 10(*a*) through 10(*d*) perforating conditions when a stencil is produced using the first control mode, the condition of ink forced through the stencil during stamping, and coloring appearance when printing is performed in the second control mode. In these drawings, arrows X and Y represent main scanning direction and auxiliary scanning direction, respectively. Here, the main scanning direction X implies the direction of array of the thermal elements in the thermal head 32, and the auxiliary scanning direction Y implies the feeding direction of the stencil plate 120 or the image recording sheet 200 provided by the platen 34.

As shown in FIG. 10 (*a*), the size of the thermal elements of the thermal head 32 used in the present embodiment are 75 microns (A) in the main scanning direction X and 95 microns (B) in the auxiliary scanning direction Y. Further, a pitch length Pa between the neighbouring heat generating elements is 141 microns. When the transport/head pressing motor (step motor) 94 is driven using 1-2 phase drive, its angular rotation angle for every one step is one half that compared to when it is driven using 2-2 phase drive. Therefore, as shown in FIG. 10 (*a*), if the transport pitch Pb is 141 microns when using 2-2 phase drive, the transport pitch Pc will be 70.5 microns when using 1-2 phase drive.

When processes are performed for producing a stencil in the stencil plate 120 using the first control mode, the transport/head pressing motor 94 is set for 2-2 phase drive and transported a distance of Pb for each step as shown in FIG. 10 (*b*). With every transport step the heat-sensitive stencil sheet 122 is perforated.

Here, the item to be perforated is a laminated thin stencil film formed from a thermoplastic film and a layer of a blend of tissure bonded thereto. The thermoplastic film is 1.5 microns thick PET material with a melting point of 199° C. The blend tissure layer is 41 microns thick with weight per unit area of 10.8 g/m$^2$ and is made from a mixture of PET and manila hemp. If the energizing conditions such as applied electrial power and applied energy are set at 25 W/mm$^2$, 65 mj/mm$^2$, the size C of perforations in the main scanning direction X are about 75 microns and the perforation size D in the auxiliary scanning direction Y is about 75 microns. Accordingly, the perforation ratio in the main scanning direction is about 1.0 (75/75) and the perforation ratio in the auxiliary scanning direction is about 0.8 (75/95).

Stamping is performed with the stensile sheet shown in FIG. 10(*b*). For the stamping, an ink impregnated body is prepared. The ink impregnated body includes the porous material 126 made from open cell rubber, for example, foam NBR. The foam rubber is impregnated with a pigment-system oil-based ink in which pigment is dissolved in the oily solvent. Vegetable castor oil is used as the main component of the solvent and resultant viscosity of the ink is 15,000 CPS (as measured with a B type viscometer defined in Japanese Industrial Standard K7117).

As a result of the stamping, the soaked surface area is about 4.5 times as large as the perforation area. Therefore, the soaking ratio of the main scanning direction X and the auxiliary scanning direction Y becomes about 2.1 (the square root of 4.5).

Thus, the stamp lengths E and F in the main scanning direction X and the auxiliary scanning direction Y, which are the final measure of stamp quality, are about 160 microns (75×the square root of 4.5). Both the pitch Pa (141 microns) in the main scanning direction and the pitch Pb (141 microns) in the auxiliary scanning direction with respect to the thermal elements become 160 microns with respect to the printed dots. Therefore, as shown in FIG. 10 (*c*), the stamped area of each dot has only an overlap portion G (20 microns) at a set interval in the main scanning direction X and the auxiliary scanning direction Y. Consequently, ink does not excessively soak the stamped object and attractive print quality can be obtained.

Next, when printing processes are performed on the heat-sensitive recording sheet 200 using the second control mode, the transport/head pressing motor 94 is set to the 1-2 phase drive. As shown in FIG. 10 (*d*) the heat-sensitive recording sheet 200 is transported the distance Pc every step and is thermally colored. At this time, the energizing conditions are set at 25 W/mm$^2$, 105 mj/m$^2$. The heat-sensitive recording sheet 200 used is a general approximately 83 micron thick coloring heat-sensitive sheet that has a weight per unit area of 73 g/m$^2$, a luster of 10%, whiteness of 84%, and smoothness of 800 msec. As a result of printing, the size H colored in the main scanning direction becomes about 155 microns and the size I colored in the auxiliary scanning direction becomes about 85 microns. Accordingly, the coloring ratio in the main scanning direction is 2.1 (155/75) and the coloring ratio in the auxiliary scanning direction is about 0.9 (85/95).

Thus, the printed dot lengths H and I in the main and auxiliary scanning directions are greater than Pa and Pb, respectively, so that printed area of dots has an overlap portion J (15 microns) every set distance in the main scanning direction and the auxiliary scanning direction. There are therefore no whitened-out areas, and high print quality is obtainable.

Figure 11:
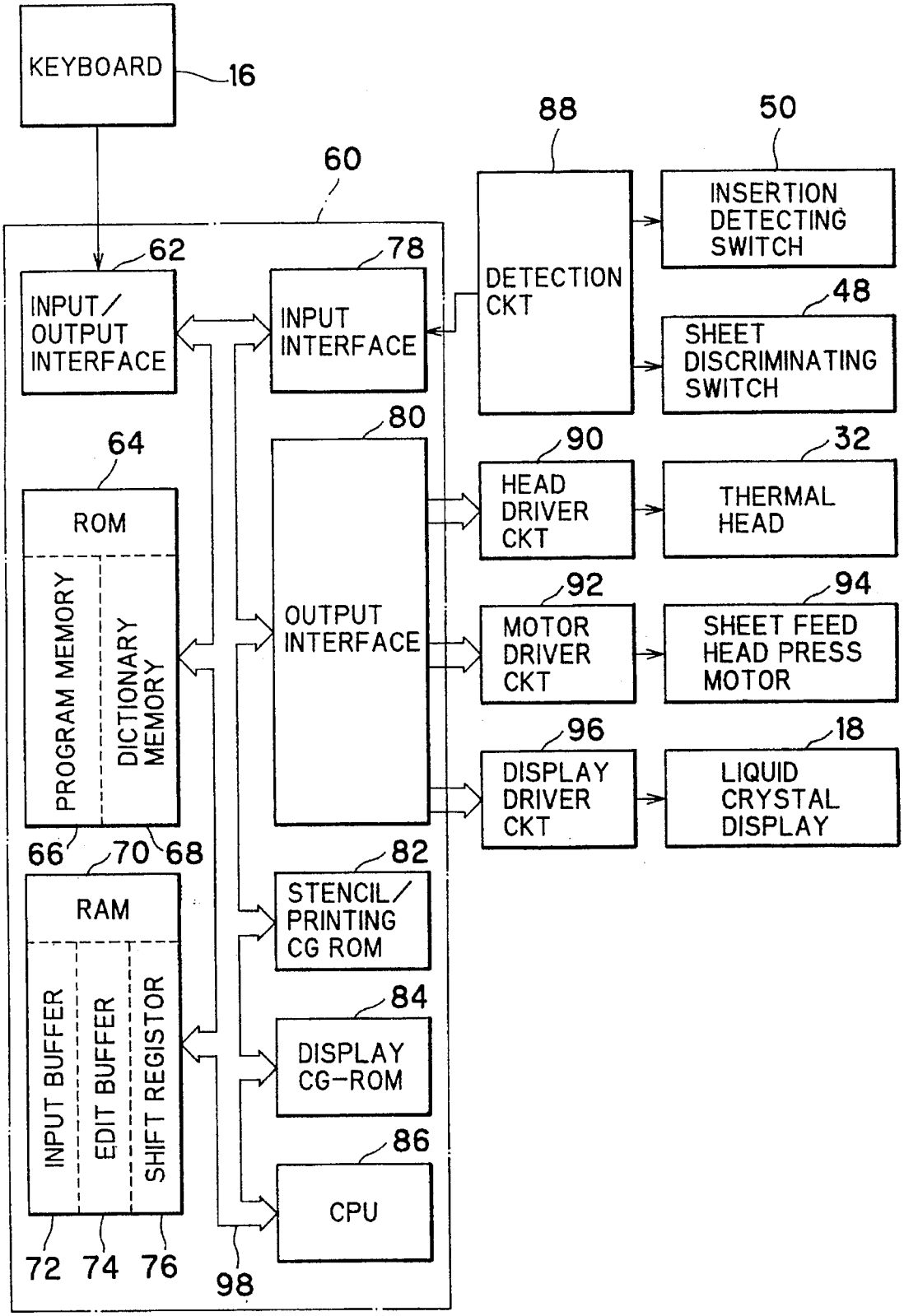
FIG. 11 is a block diagram showing an electronic control portion of a heat-sensitive stencil-production device according to the embodiment.

Next, a drive circuit for the heat-sensitive stencil-producing device of the present embodiment will next be described while reference to the block diagram shown in FIG. 11.

The keyboard 16 is connected to an input/output interface 62 of a microcomputer 60. Further, the sheet distinction switch 48, for distinguishing between whether the material to be heated 56 is a heat-sensitive recording sheet 200 or a stencil plate 120, and an insertion detection switch 50 for detecting insertion of the material to be heated 56, are connected to a detection circuit 88. The detection circuit 88 is connected to an input interface 78 of the microcomputer 60. Via a busline 98, the input/output interface 62 and the input interface 78 are connected to a CPU 86, a ROM 64, a RAM 70, a CG-ROM 82, a CG-ROM 84, and an output interface 80.

The ROM 64 includes a program memory 66, which stores programs for controlling overall operations of the present stencil-producing device 12, and a dictionary memory 68, which is used in kana (Japanese syllabary) to kanji (Chinese characters) conversion. The RAM 70 includes an input buffer 72 for storing data inputted from the keyboard 16, an edit buffer 74 for storing data for printing on the heat-sensitive recording sheet 200 or producing a stencil in the stencil plate 120, and a shift resistor 76 and other necessary counters and resistors.

The CG-ROM 82 is adapted for stencil production of the stencil plate 120 and printing of the heat-sensitive recording sheet 200. To this effect, the stencil production and printing CG-ROM 82 has dot patterns stored therein. The dot patterns are for printing characters, marks, and the like, that are indicated by code data for all characters inputted from the keyboard 16, in a dot matrix style, on the heat-sensitive recording sheet 200. The dot patterns are stored in the CG-ROM 82 in correspondence with the code data. In the present embodiment, the dot patterns for printing on the heat-sensitive recording sheet 200 are to form a positive image.

The CG-ROM 84 is adapted for display at the liquid crystal display 18. The CG-ROM 84 has display dot patterns stored therein in correspondence with the code data of each character. The display dot patterns are for displaying characters on the liquid crystal display 18.

A thermal head drive circuit 90, that is connected to the thermal head 32, a motor drive circuit 92, that is connected to the transport/head pressing motor 94, and a display drive circuit 96, that is connected to the liquid crystal display 18, are connected to the output interface 80.

Figure 12:
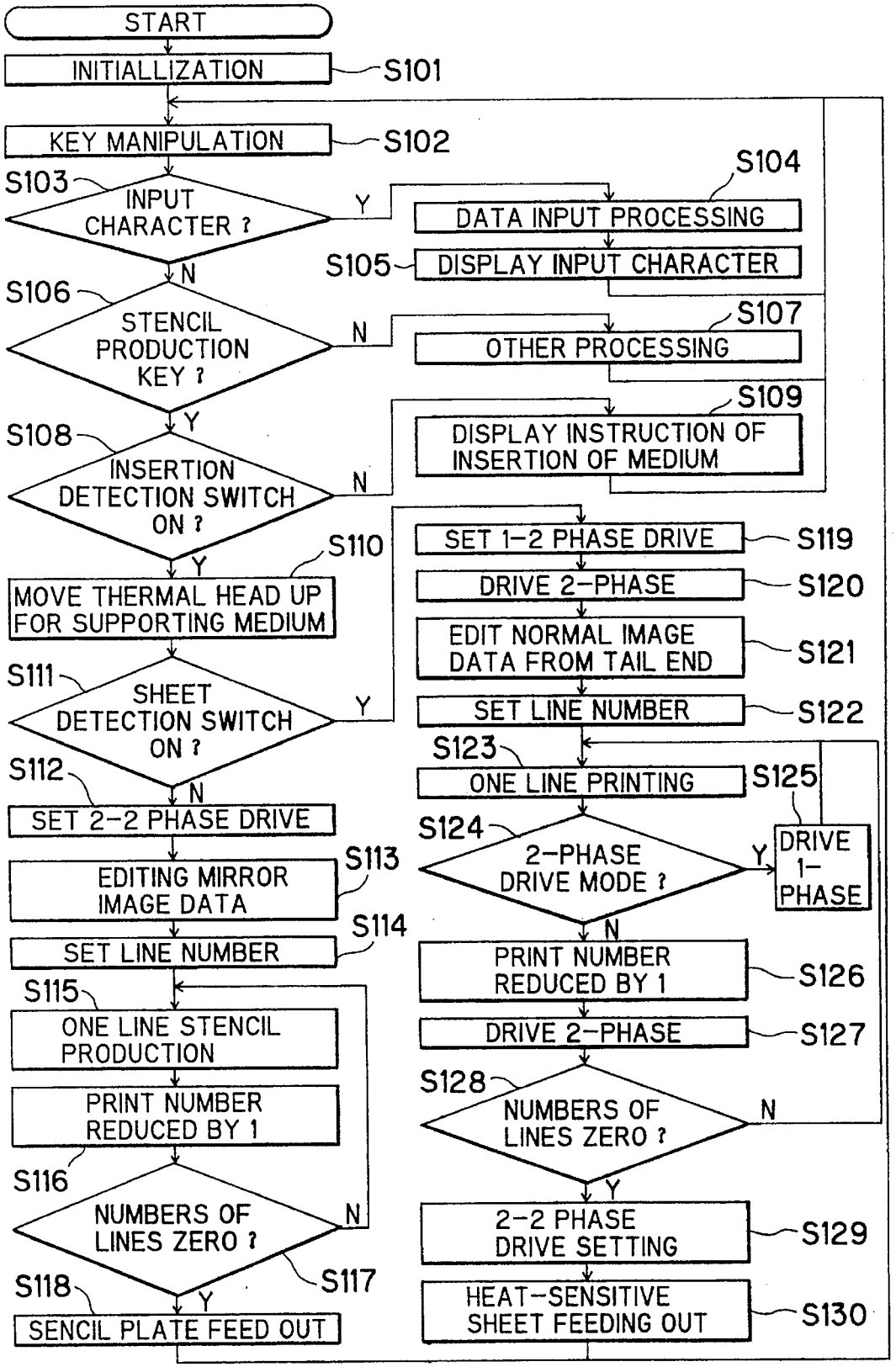
FIG. 12 is a flowchart showing flow of a main program according to the first example.

Next, a main program routine according to a first example of the control method in the heat-sensitive stencil-producing device of the present embodiment will be described with reference to a flowchart shown in FIG. 12.

When the ON/OFF key 20 is manipulated to turn the power source on, the CPU 86 initializes the components in the periphery of the CPU 86 in step 101 (hereinafter simply referred to S101, other steps will be labeled in the same manner).

Next, the keys of the keyboard 16 are manipulated in S102. Whether or not input from the keyboard 16 is from a character key is determined in S103. If input is from a character key (S103: YES), the CPU 86 performs data input processing in S104. Further, the inputted character is displayed on the liquid crystal display 18 in S105. The program then returns to the key scan routine in S102. If input is not from a character key (S103: NO), judgment is made in S106 as to whether or not the stencil-production key has been pressed. If not (S106: NO), other processes are performed in S107 and the program returns to S102.

Here, an operator inserts a stencil plate 120 or a heat-sensitive recording sheet 200 through the insertion port 24. At this time, the stopper (not shown) protrudes into the sheet transport path at the interior of the insertion port 24 at the position indicated by the arrow B in FIGS. 5 and 6. Therefore, the stencil plate 120 or the heat-sensitive recording sheet 200 abuts the stopper and will not proceed further to the interior of the device.

If the stencil-production key 22 is depressed (S106: YES), whether the insertion detection switch 50 is ON is determined in S108. If not, (S108: NO), an instruction to insert a stencil plate 120 or a heat-sensitive recording sheet 200 is displayed on the liquid crystal display 18 in S109 and the program returns to S102.

On the other hand, if the insertion detection switch 50 is ON (S108: YES), the CPU transmits a drive signal to the motor driver circuit 92 for causing the transport/head pressing motor 94 (step motor) to rotate a predetermined amount and stop. Because of the angular rotation of the motor 94, the support plate 36 rotates upward and the thermal head 32 urges the stencil plate 120 or the heat-sensitive recording sheet 200 against the platen 34 in S110. Then, whether the sheet distinction switch 48 is ON is determined in S111. When a heat-sensitive recording sheet 200 has been inserted through the insertion port 24 (S111: YES), the program proceeds to S119 into the second control mode. On the other hand, when a stencil plate 120 has been inserted through the insertion port 24 (S111: NO), the program proceeds to S112 into the first control mode.

In the first control mode, the steps S112 through S118 are performed. That is, when in the first control mode, the CPU 86 outputs to the motor driver circuit 92 a drive signal indicative of performing 2-2 phase energization in the transport/head pressing motor 94 in S112. Then, the mirror image data edition for perforation is performed in S113. In the editing routine, the CPU 86 retrieves code data (of characters, marks, and the like inputted from the keyboard 16 that was stored in the order inputted into the input buffer 72) from the input buffer 72 in the order inputted. The CPU 86 retrieves dot patterns (for the heat-sensitive recording sheet) for characters indicated by the retrieved code data from the stencil-production and printing CG-ROM 82. The CPU 86 reverses the dot patterns and stores the reversed dot patterns in order in the edit buffer 74 of the RAM 70 as dot pattern data for perforation. That is, the input order characters are each reversed from left to right into a mirror image and stored into the edit buffer 74.

Next, in S114, the CPU 86 computes the number of stencil production lines from the perforation dot patterns stored in the edit buffer 74 and stores the computed line numbers. A line in stencil production corresponds to an array of the thermal elements aligned in the main scanning direction X (FIG. 10 (*a*)) of the thermal head 32, and means one array of perforations formed when all or selective one of thermal elements are energized one time.

Next, the stopper is moved away from the sheet transport path and CPU 86 retrieves the perforation dot patterns from the edit buffer 74 for every stencil-production line. The CPU 86 outputs the perforation dot patterns to the head drive circuit 90 as one stencil-production line worth of data for controlling the thermal elements. The head drive circuit 90 selectively energizes the thermal elements of the thermal head 32 according to the data for controlling the thermal elements. This energizing control for one line of stencil production is performed at a predetermined time at the conditions of 25 $W/mm^2 \times 65$ $mj/mm^2$. Afterward, the transport/head pressing motor 94 is driven one step in reverse direction under the 2-2 phase energization in S115.

Thereafter, the number of the stencil-production line is reduced one in S116 and whether that value is 0 or not is determined in S117. If not 0 (S117: NO), the program returns to S115. In this way, for every line of the stencil-production line, energization of the thermal elements of the thermal head 32 and one step driving by the 2-2 phase in the transport/head pressing motor 94 are performed.

When the final stencil-production line is completed (S117: YES), the CPU 86 reversedly drives the transport/head pressing motor 94 so as to feed the stencil plate 120 to the base of the stamp receiving portion 26 and moreover to directly underneath the stamp block 140 in S118, and the program returns to S102. By this, stencil production of the stencil plate 120 is completed and the stencil plate 120 is disposed directly under the stamp block 140 so that the heat-sensitive stencil sheet 122 faces downward and the ink-impermeable film 130 faces upward. Therefore, the stencil plate 120 can be adhered to the stamp block 140 by the adhesive layer 146 via the ink-impermeable film 130.

In contrast to the above, if the determination in S111 falls YES, the CPU 86 enters the second control mode for forming perforated image in the heat-sensitive image recording sheet 200.

In the second control mode, first, the drive system of the transport/head pressing motor 94 is set to the 1-2 phase energizing mode in S119. Then in S120, the coil phase for performing 2 phase energizing mode in a subsequent reverse rotation, for example, with a four phase motor, the coil for the AB phase, the BC phase, the CD phase, or the DA phase, is selected, and that the selected 2-phase drive is stored in a drive condition flag memory. The drive condition flag memory is adapted for storing the driving condition, i.e., for storing single phase driving or dual phase driving.

Afterward, the normal image data for printing on the heat-sensitive recording sheet is edited from the tail end in S121. In this editing routine, the CPU 86 retrieves code data from the input buffer 72 in the reverse order of that at which the code data such as characters and marks were inputted from the keyboard 16. The CPU 86 retrieves from the stencil-production/printing CG-ROM 82 the character dot patterns corresponding to the retrieved code data and stores the character dot patterns in order into the edit buffer 74 of the RAM 70 as dot pattern data for printing.

Next, the CPU 86 computes the number of print lines from the printing dot patterns stored in the edit buffer 74 and stores the line numbers in S122. As described above, a line during printing corresponds to the array of the thermal elements aligned in the main scanning direction (FIG. 10 (*a*)) of the thermal head 32 and means one line of colored dots formed when the thermal elements are energized one time.

Next, the CPU 86 generates a signal for moving the stopper away from the sheet transport path, and retrieves the print dot patterns from the edit buffer 74 in S123 for every print line starting with the first line. The CPU 86 outputs the print dot patterns data to the head drive circuit 90 as one print line worth of data for controlling the thermal elements. The head drive circuit 90 selectively energizes the thermal elements of the thermal head 32 according to the data for controlling the thermal elements. This energizing control for one line of printing is performed at a predetermined time at the conditions of 25 $W/mm^2$, 105 $mj/mm^2$. That is the applied energy in the second control mode is higher than that in the first control mode.

Next, the CPU 86 retrieves the contents stored in the drive condition flag memory, and determines in S124 whether the transport/head pressing motor 94 is being driven by the 2-phase drive mode. At first, the determination in S124 falls YES because 2-phase drive mode is performed in S120.

Next, for the subsequent 1 phase drive mode, electrical current is applied for a selected one of the coils for a predetermined period of time in S125, and the control goes back to S123. The 1-phase drive is for, for example, energizing the B phase when the energizing phase energized in S120 is the AB phase of the 4-step motor, for energizing the C phase when the energized phase is the BC phase, for energizing the D phase when the energized phase is the CD phase, and for energizing the A phase when the energized phase is the DA phase. At this time, data indicating the 1-phase drive is stored in the drive condition flag memory instead of the previous 2-phase drive data. In S123, the data for controlling the thermal elements is the same as those during the 2-phase drive mode. Therefore, the same thermal elements are energized.

Next, in the determination routine of S124, the CPU 86 again retrieves content stored in the drive condition flag memory and determines whether the transport/head pressing motor 94 is set for 2-phase drive mode in S124. Because the 1-phase drive was used for the second energization of the thermal elements, the determination in S124 falls "NO" so the program proceeds to S126 where the determined print line number is reduced by 1.

Afterward, the CPU 86 drives the transport/head pressing motor 94 one step in succession in the reverse direction. In this case, because the energizing condition directly beforehand was the 1-phase energizing condition, energizing for 2-phase energizing is performed for a predetermined time in the coil. For example, the AB phase is energized when the 4-phase step motor was in the A phase, the BC phase is energized when it was in the B phase, the CD phase is energized when it was in the C phase, and the DA phase is energized when it was in the D phase. The data indicating the 2-phase drive is stored in the drive condition flag memory instead of the 1-phase drive when this energizing is performed.

Then, in S128, determination is made as to whether or not the print line number becomes 0. If the determination falls "NO", the routine returns to the step S123. For this reason, the print dot pattern of the next print line is retrieved from the edit buffer 74 and outputted to the head drive circuit 90 as data for controlling the thermal elements to print one line. Printing is performed for one line. Afterward, the next phase is energized in S125 and again printing is performed using the same data for controlling the thermal elements. This is repeated until the number of print lines is 0.

When the print line number is 0 (S128: YES), CPU 86 changes the drive mode of the transport/head pressing motor 94 to 2-2 phase drive mode in S129 for feeding the heat-sensitive recording sheet. That is, the CPU 86 causes the transport/head pressing motor 94 to rotate a predetermined amount in the reverse direction under the 2-2phase drive mode. The upper and lower surfaces of the heat-sensitive recording sheet for which printing has been completed (that is, upon which the characters stored in the input buffer 72 are printed in the reverse order of the order in which the dot patterns are successively stored in the input buffer 72 so as to produce a positive image) are reversed upside down by the sheet guide 281, and the heat-sensitive recording sheet 200 is discharged to the discharge guide tray 30 with the printed surface facing upward as shown in FIG. 9. At this time, the characters, stored in the input buffer 72 in the order inputted by an operator, are printed on the heat-sensitive recording sheet 200 in the order inputted. Therefore, the output print image can be easily acknowledged.

As described above, the stencil plate 120 is fed using the 2-2 phase drive mode, whereas the heat-sensitive recording sheet 200 is fed using the alternate 1-2 phase drive mode. Therefore, the feed pitch in case of the stencil plate during perforating operation is twice as large as that in case of the heat-sensitive recording sheet 200. On the other hand, the amount to which the thermal elements of the thermal head are energized is 25 W/mm$^2$, 65 mj/mm$^2$ for the stencil plate 120 and 25 W/mm$^2$, 105 mj/mm$^2$ for the heat-sensitive recording sheet 200. Therefore, the amount the thermal elements are energized, and therefore the amount of heat transmitted to the heat-sensitive recording sheet 200, is greater than that to the stencil plate 120. For this reason, the perforations formed in the heat-sensitive stencil sheet 122 of the stencil plate 120 are sufficiently small in size taking the soaking characteristic of the ink into consideration, and perforations formed in the heat-sensitive recording sheet 200 has sufficiently large in size for avoiding white-out portions and for improving printing quality.

Thus, in the present embodiment, the kind of the object (the stencil plate or a heat-sensitive recording sheet) to be processed and inserted into the device is automatically determined, and the first and the second control modes are automatically switched therebetween based on the result of the determination. Therefore, there is no need for an operator to manually switch modes each time and processes are always performed according to the type of object to be processed.

Figure 13:
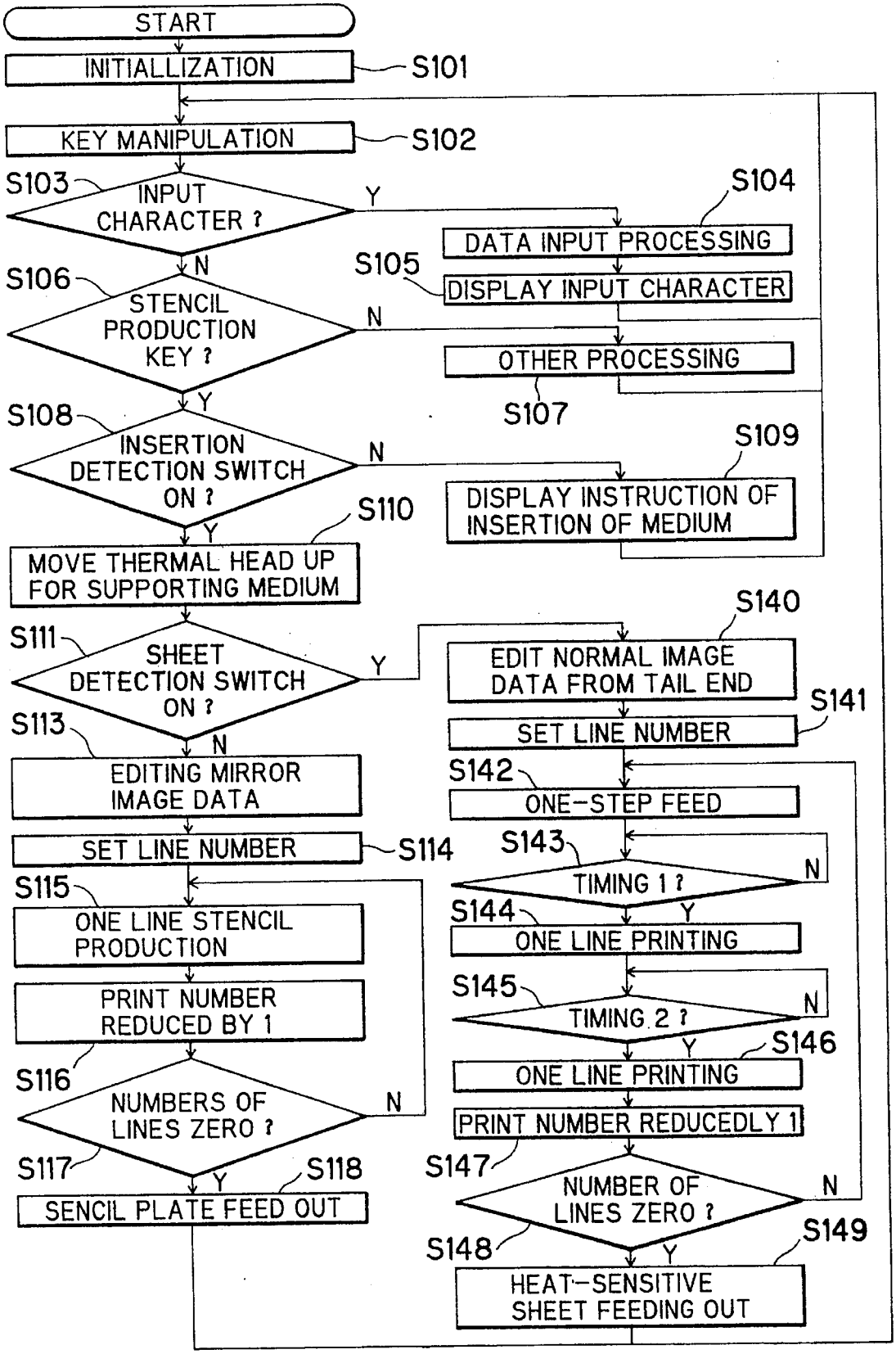
FIG. 13 is a flowchart showing flow of a main program according to a second example.

Next, a main program routine according to a second example of the control method in the heat-sensitive stencil-producing device of the present embodiment will be described with reference to a flowchart shown in FIG. 13. In the first example described above, the drive method for the transport/head pressing motor 94 was changed for feeding the heat-sensitive recording sheet 200. However, in the second example, the drive method for the transport/head pressing motor 94 is not changed for feeding the heat-sensitive recording sheet 200 and the stencil plate 120. Instead, energization to the thermal elements of the thermal head is changed. Energization is performed once for each step during feed of the stencil plate 120 and twice for each step during feed of the heat-sensitive recording sheet 200. This will be described while referring to the flow chart in FIG. 13 in which steps that are the same as those in FIG. 12 are provided with the same numbering and detailed explanation thereof will be omitted.

The operator inputs desired characters, so that the code data for inputted characters is stored in the order inputted into the input buffer 72, and the stencil plate 120 is set in the device. When the stencil-production key 22 is depressed, the determination in S111 will be "NO" and stencil-production processes will be performed under a first control mode. At this time, the drive mode for the transport/head pressing motor 94 is fixedly set to the 2-2 phase drive mode (or fixed to the 1-2 phase drive mode). The energizing amount to the thermal elements of the thermal head is set to 25 W/mm$^2$, 65 mj/mm$^2$.

After the stencil plate 120 has been produced into a stencil, the operator sets a heat-sensitive recording sheet 200 into the device and depresses the stencil-production key 22. The determination in S111 is "YES" so that the routine goes into a second control mode (S119–S130).

That is, in S140, editing process is performed in the manner similar to the step S121 in the first example. That is, the CPU 86 edits the normal image data for printing on the heat-sensitive recording sheet from the tail end in S140. In this edit routine, code data representing characters and marks inputted through the keyboard 16 are stored into the input buffer 72 in the order inputted. The CPU 86 retrieves the code data in the reverse order of the order in which the code data was inputted. The CPU 86 retrieves dot patterns (for a heat-sensitive recording sheet) for the characters indicated by the retrieved code data from the stencil-production/printing CG-ROM 82. The CPU 86 then stores the dot patterns in the edit buffer 74 of the RAM 70 in order as print dot pattern data.

Afterward, similar to the step S122 in the first example, the CPU 86 computes the print line number of the print dot pattern stored in the edit buffer 74 and stores the computed line numbers in S141.

Next, the CPU 86 outputs a drive signal for retracing the stopper away from the print sheet transport path, outputs a command to the motor drive circuit 92 in S142, in order to reversedly drive the transport/head pressing motor 94 one step, and waits for the predetermined timing T1 to pass in S143. After the time T1 passes, one line of printing is performed in S144. In this step, the CPU 86 retrieves print dot patterns from the edit buffer 74 for every print line from the first line, and outputs the dot patterns to the head drive circuit 90 as data for controlling the thermal elements to print one line. The head drive circuit 90 is for selectively energizing the thermal elements of the thermal head 32 according to the data for controlling the thermal elements. The control for energizing one line of printing is performed over a predetermined time at 25 W/mm$^2$, 105 mj/mm$^2$.

Afterward, the CPU 86 waits for the predetermined time T2 to pass in S145. After the time T2 has passed, processes for printing one line are again performed in S146. At this time, data for controlling the thermal elements when controlling energizing in S144 is used and processes for printing one line are performed. Here, the time period T1 and T2 are set so that during the time from when the command signal for reversedly driving the transport/head pressing motor 94 one step is outputted until the motor is finished being driven, that is, during one step rotation of the motor, printing processes are performed twice on the heat-sensitive recording sheet in the same interval.

Afterward, the CPU 86 reduces the print line number by one in S147 and determines whether the print line number is 0 in S148. If not (S148: NO), the program returns to S142. For this reason, printing processes are performed twice with the same data for controlling the thermal elements for every step of the motor. When printing processes are performed twice for the final print line, the determination in S148 falls "YES", and feed processes are performed for the heat-sensitive recording sheet 200 in S149. That is, the transport/head pressing motor 94 is rotated a predetermined amount in the reverse direction and the heat-sensitive recording sheet 200, with printing completed (i.e, the characters stored in the input buffer 72 are all printed in a normal image in reverse order), is driven so that its upper and lower surfaces reverse and is discharged onto the discharge guide tray 30 with the print surface facing up. The characters stored by an operator into the input buffer 72 are aligned on the heat-sensitive recording sheet 200 in the order inputted so that confirmation to the printed image can be easily made.

While the invention has been described with reference to the specific embodiments thereof, it would be apparent to those skilled in the art that various changes and modifications may be made therein without departing from the scope of the invention. The followings are the conceivable modifications:

(1) The feed amount or pitch of one print line of the object transported by the sheet feed motor (motor 94) can be fixed regardless of the heat-sensitive recording sheet or the stencil plate, whereas the heat amount of the thermal elements of the thermal head in the first control mode for the stencil plate can be set less than the heat amount in the second control mode for the heat-sensitive recording sheet.

(2) The heat amount of the thermal elements of the thermal head can be fixed regardless of the kind of the object, whereas the one line-feed amount in the second control mode for the heat-sensitive recording sheet can be set less than the one line-feed amount in the first control mode for the stencil plate. That is, the sheet feed amount by the sheet feed motor (the transport/head pressing motor 94) for each heating of the thermal head in the case of the heat-sensitive recording sheet 200 can be set less than for the case of the stencil plate.

(3) The heat amount for the thermal elements of the thermal head can be fixed, and the feed amount by the sheet feed motor (transport/head pressing motor 94) can also be fixed. On the other hand, a heating cycle of the thermal head for one fixed amount of the sheet feed can be set different between the case of the stencil plate 120 and the heat-sensitive recording sheet 200. That is, the stencil plate 120 is heated only once per each step feed whereas the heat-sensitive recording sheet 200 is heated twice or more per each step feed.

(4) In the above-described embodiments, perforation and printing is performed by the head pressing motor 94 moving the stencil plate or the heat-sensitive recording sheet in regards to the thermal head. In this connection, the head pressing motor 94 can be referred to transport means. However, the stencil plate and the heat-sensitive recording sheet can be kept stationary and the thermal head can be moved. Accordingly, the transport means of the present invention includes all mechanisms for providing relative movement between the heating means (for example, a thermal head) and the stencil plate (or the heat-sensitive recording sheet).

(5) In the above-described embodiment, the keyboard serves as an input mechanism. However, data of characters, marks, and the like can be inputted from, for example, the reception terminal (not shown) of a personal computer and stencils can be produced with a heat-sensitive stencil-producing device following the above-described procedures.

What is claimed is:

1. An image forming device for forming a dot image on a heat-sensitive image recording medium, the device including heating means for thermally forming the dot image on the heat-sensitive image recording medium, the heating means comprising a thermal head comprising a plurality of thermal elements, transport means for providing relative movement between the heating means and the heat-sensitive image recording medium in a transport direction, and an inserting section for inserting the heat-sensitive image recording medium into the heating means, the improvement comprising:

the heat-sensitive image recording medium including a first heat-sensitive image recording medium which forms a first dot image and a second heat-sensitive image recording medium which forms a second dot image;

distinction means for distinguishing the first heat-sensitive image recording medium from the second heat-sensitive image recording medium upon insertion of one of the first and second heat-sensitive image recording mediums at the inserting section; and control means connected to the distinction means for automatically switching at least one of the heating means and the transport means between a first control mode and a second control mode in response to a distinction result from the distinction means, the first dot image being formed under the first control mode, and the second dot image being formed under the second control mode, so that at least one of size and density of dots generated in the first dot image is smaller and lower than those generated in the second dot image, wherein the control means further comprises means for setting a relative moving distance, with respect to each heating of the thermal head, between the second heat-sensitive image recording medium and the thermal elements smaller during the second control mode than that between the first heat-sensitive image recording medium and the thermal elements during the first control mode.

2. The image forming device as claimed in claim 1, wherein the plurality of thermal elements are aligned in an array in a direction substantially orthogonal to the transport direction, and wherein the control means comprises means for controlling the plurality of thermal elements to generate heat in selected thermal elements corresponding to an intended dot image.

3. The image forming device as claimed in claim 2, wherein the control means further comprises means for setting a heating amount of the thermal head smaller during the first control mode than during the second control mode.

4. The image forming device as claimed in claim 3, wherein the first heat-sensitive image recording medium comprises a stencil plate, and the second heat-sensitive image recording medium comprises a heat-sensitive image recording sheet.

5. The image forming device as claimed in claim 4, wherein the stencil plate comprises a heat-sensitive stencil sheet and an ink-impregnated body covered with the heat-sensitive stencil sheet.

6. The image forming device as claimed in claim 5, wherein the first dot image comprises a stencil image in which perforations are formed in the stencil sheet in a perforated dot image pattern by selective heating of the plurality of thermal elements, and wherein the second dot image comprises a printed dot image printed on the heat sensitive image recording sheet by selective heating of the plurality of thermal elements.

7. The image forming device as claimed in claim 1, wherein the first heat-sensitive image recording medium comprises a stencil plate, and the second heat-sensitive image recording medium comprises a heat-sensitive image recording sheet.

8. The image forming device as claimed in claim 7, wherein the stencil plate comprises a heat-sensitive stencil sheet and an ink-impregnated body covered with the heat-sensitive stencil sheet.

9. The image forming device as claimed in claim 8, wherein the first dot image comprises a stencil image in which perforations are formed in the stencil sheet in a perforated dot image pattern by selective heating of the plurality of thermal elements, and wherein the second dot image comprises a printed dot image printed on the heat sensitive image recording sheet by the selective heating to the plurality of thermal elements.

10. The image forming device as claimed in claim 1, wherein the control means further comprises:

first setting means for setting a heating amount of the thermal head smaller during the first control mode than during the second control mode; and second setting means for setting a relative moving distance, with respect to each heating of the thermal head, between the second heat-sensitive image recording medium and the thermal elements smaller during the second control mode than that between the first heat-sensitive image recording medium and the thermal elements during the first control mode.

11. The image forming device as claimed in claim 10, wherein the first heat-sensitive image recording medium comprises a stencil plate, and the second heat-sensitive image recording medium comprises a heat-sensitive image recording sheet.

12. The image forming device as claimed in claim 11, wherein the stencil plate comprises a heat-sensitive stencil sheet and an ink-impregnated body covered with the heat-sensitive stencil sheet.

13. The image forming device as claimed in claim 12, wherein the first dot image comprises a stencil image in which perforations are formed in the stencil sheet in a perforated dot image pattern by selective heating of the plurality of thermal elements, and wherein the second dot image comprises a printed dot image printed on the heat sensitive image recording sheet by selective heating of the plurality of thermal elements.

14. An image forming device for forming a dot image on a heat-sensitive image recording medium, the device including heating means for thermally forming the dot image on the heat-sensitive image recording medium, the heating means comprising a thermal head including a plurality of thermal elements, transport means for providing relative movement between the heating means and the heat-sensitive image recording medium in a transport direction, and an inserting section for inserting the heat-sensitive image recording medium into the heating means, and the improvement comprising:

the heat-sensitive image recording medium including a first heat-sensitive image recording medium which forms a first dot image and a second heat-sensitive image recording medium which forms a second dot image;

distinction means for distinguishing the first heat-sensitive image recording medium from the second heat-sensitive image recording medium upon insertion of one of the first and second heat-sensitive image recording mediums at the inserting section; and control means connected to the distinction means for automatically switching at least one of the heating means and the transport means between a first control mode and a second control mode in response to a distinction result from the distinction means, the first dot image being formed under the first control mode, and the second dot image being formed under the second control mode, so that at least one of size and density of dots generated in the first dot image is smaller and lower than those generated in the second dot image, wherein the control means further comprises means for setting the number of times the thermal head is heated for each dot smaller during the second control mode than during the first control mode.

15. The image forming device as claimed in claim 14, wherein the first heat-sensitive image recording medium comprises a stencil plate, and the second heat-sensitive image recording medium comprises a heat-sensitive image recording sheet.

16. The image forming device as claimed in claim 15, wherein the stencil plate comprises a heat-sensitive stencil sheet and an ink-impregnated body covered with the heat-sensitive stencil sheet.

17. The image forming device as claimed in claim 16, wherein the first dot image comprises a stencil image in which perforations are formed in the stencil sheet in a perforated dot image pattern by selective heating of the plurality of thermal elements, and wherein the second dot image comprises a printed dot image printed on the heat sensitive image recording sheet by selective heating of the plurality of thermal elements.

18. The image forming device as claimed in claim 11, wherein the control means further comprises:

first setting means for setting a heating amount of the thermal head smaller during the first control mode than during the second control mode; and second setting means for setting a heating cycle of the thermal head shorter during the second control mode than during the first control mode.

19. A heat-sensitive stencil production device for producing a stencil in a stencil plate, the stencil plate including a heat-sensitive stencil sheet and an ink-impregnated body covered with the heat-sensitive stencil sheet, the device including heating means for thermally forming a perforated dot image on the heat-sensitive stencil sheet or a heat-sensitive image recording sheet including a thermal head comprising a plurality of thermal elements aligned in an array in a direction orthogonal to the transport direction, transport means for providing relative movement between the heating means and the stencil plate for step-wisely feeding the heat-sensitive stencil sheet or the heat-sensitive image recording sheet in a transport direction, the transport means comprising a stepping motor connected to the control means and a platen positioned in confrontation with the thermal head and operatively connected to the stepping motor for stepwise rotation to stepwisely feed one of the heat-sensitive stencil plate and the heat-sensitive image recording sheet, the improvement comprising:

an inserting section for inserting the heat-sensitive stencil plate into the heating means, the inserting section also allowing insertion of the heat sensitive recording sheet on which a printed dot image is to be formed;

distinction means for distinguishing between whether the stencil plate or the heat-sensitive recording sheet is inserted in the inserting section; and control means connected to the distinction means for automatically switching, based on a distinction result from the distinction means, between a first control mode for controlling at least one of the transport means and the heating means for producing the dot image on the stencil plate and a second control mode for controlling at least one of the transport means and the heating means for producing the printed dot image on the heat-sensitive recording sheet, so that at least one of dot size and dot density of the dot image on the stencil plate is smaller and lower than those of the dot image on the heat-sensitive recording sheet, the control means comprising means for controlling the plurality of thermal elements to generate heat in selected thermal elements corresponding to an intended dot image, and means for setting a relative moving distance with respect to each heating of the thermal head, between the heat-sensitive image recording sheet and the thermal elements smaller during the second control mode than that between the heat-sensitive stencil plate and the thermal elements during the first control mode, the means for setting the relative moving distance comprising means for increasing an angular rotation angle of the stepping motor greater in the first control mode than that in the second control mode.

20. The heat-sensitive stencil production device as claimed in claim 19, wherein the control means further comprises means for setting a heating amount of the thermal head smaller during the first control mode than during the second control mode.

21. The heat-sensitive stencil production device as claimed in claim 19, wherein the control means further comprises means for setting the number of times the thermal head is heated for each dot larger during the second control mode than during the first control mode.

22. The heat-sensitive stencil production device as claimed in claim 19, wherein the control means further comprises:

first setting means for setting a heating amount of the thermal head smaller during the first control mode than during the second control mode; and second setting means for setting a relative moving distance, with respect to each heating of the thermal head, between the heat-sensitive image recording sheet and the thermal elements smaller during the second control mode than that between the heat-sensitive stencil plate and the thermal elements during the first control mode.

23. The heat sensitive-stencil production device as claimed in claim 20, wherein the control means further comprises:

first setting means for setting a heating amount of the thermal head smaller during the first control mode than during the second control mode; and second setting means for setting a heating cycle of the thermal head shorter during the second control mode than during the first control mode.

* * * * *